US011005201B2

(12) United States Patent
Lin

(10) Patent No.: US 11,005,201 B2
(45) Date of Patent: May 11, 2021

(54) CONNECTOR THAT AUTOMATICALLY LATCH-LOCKS A FLAT CONDUCTING WIRE

(71) Applicant: P-TWO INDUSTRIES INC., Taoyuan (TW)

(72) Inventor: Shien-Chang Lin, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 0 days.

(21) Appl. No.: 16/667,651

(22) Filed: Oct. 29, 2019

(65) Prior Publication Data

US 2020/0161785 A1 May 21, 2020

(30) Foreign Application Priority Data

Nov. 15, 2018 (TW) ..... 107140628

(51) Int. Cl.
*H01R 12/77* (2011.01)
*H01R 13/627* (2006.01)

(52) U.S. Cl.
CPC ..... *H01R 12/774* (2013.01); *H01R 13/6275* (2013.01)

(58) Field of Classification Search
CPC ..... H01R 12/774; H01R 13/6275
See application file for complete search history.

(56) References Cited

U.S. PATENT DOCUMENTS

| | | | | |
|---|---|---|---|---|
| 6,692,294 | B2 * | 2/2004 | Kobayashi | H01R 12/775 439/496 |
| 8,337,230 | B1 * | 12/2012 | Kurachi | H01R 12/79 439/328 |
| 9,401,554 | B2 * | 7/2016 | Takane | H01R 12/79 |
| 2002/0132518 | A1 * | 9/2002 | Kobayashi | H01R 12/775 439/496 |
| 2015/0270632 | A1 * | 9/2015 | Takane | H01R 12/716 439/78 |
| 2016/0126649 | A1 * | 5/2016 | Takane | H01R 12/774 439/660 |
| 2020/0161785 | A1 * | 5/2020 | Lin | H01R 12/774 |

* cited by examiner

*Primary Examiner* — Abdullah A Riyami
*Assistant Examiner* — Nader J Alhawamdeh
(74) *Attorney, Agent, or Firm* — Sinorica, LLC

(57) ABSTRACT

The present invention discloses a connector for flat conducting wires that is directed into the insertion opening, the front end comes in contact with the first locking protrusion and the second locking protrusion of the connector, respectively causing the first elastic arm and the second elastic arm to deform, thereby causing the first operating part and the second operating part to move towards the third surface until the indented notches correspond to the first locking protrusion and the second locking protrusion, which subsequently causes the first elastic arm and the second elastic arm to return to their former position by means of elastic force, latch-locking the front end of the flat conducting wire in the accommodating space, and through exerting an external force on the upper portion of the first operating part and the upper portion of the second operating part to unlatch and separate from the accommodating space.

8 Claims, 4 Drawing Sheets

CONNECTOR THAT AUTOMATICALLY LATCH-LOCKS A FLAT CONDUCTING WIRE

FIELD OF THE INVENTION

The present invention relates to a connector, particularly, to a connector that automatically latch-locks a flat conducting wire.

BACKGROUND OF THE INVENTION

A conventional connector acts as an intermediary connecting component which facilitates the connection of a conducting wire to a circuit board, and with its advantage of no soldering the conducting wire to the circuit board required, a user can easily perform electrical connection through plugging.

In order for stable and firm contact between a connector and a conducting wire, various types of connection methods have been developed, e.g. via automatic latch-locking to readily connect the connector and the conducing wire without loosening off, where in the aforementioned motion the connecting wire is automatically latched during the course of insertion into the connector to ensure connection of the two. However, the conventional connector with automatic latch-lock feature, due to its structural design, causes uncertainty for a user as to the exact location of the locking protrusions, as other than waiting for sound generated from contacting the locking protrusion, completion of automatic latch-locking can not be anticipated through visual observation, thus leaving the possibility of misjudgment by a user that latching-locking has been completed. Moreover, design engineers may not be able to determine where to dispose indented notches on a conducting wire unless specifications of the corresponding connector are provided. In addition, as the locking protrusions are generally located near the end, automatic latch-locking malfunction may easily arise in case of elastic arm fatigue or insufficient elastic force.

Therefore, the present invention provides a connector capable of overcoming the shortcomings present in the conventional connectors.

SUMMARY OF THE INVENTION

The first objective of the present invention is to provide a connector having a first elastic locking part and a second elastic locking part to achieve automatically latch-locking flat conducting wires (e.g. flexible flat cable (FFC) or flexible printed circuit, (FPC)) and releasing latch-locking by exerting an external force.

The second objective of the present invention is to provide said connector capable of driving the first elastic locking part and the second elastic locking part either respectively or concurrently, in order to accommodate different user scenarios.

The third objective of the present invention is to provide said connector wherein a locking protrusion of the elastic locking part is disposed on the lower portion of the operating part and enables the lower portion to face the same force direction as upper portion of the operating part, in order to achieve zero direct force loss.

In order to achieve the aforesaid objectives among others, the present invention provides a connector for a flat conducting wire. The flat conducting wires include a wire end and indented notches disposed respectively on the two lateral sides of the front end. The connector includes a casing, a terminal, a first elastic locking part and a second elastic locking part. The casing forms a accommodating space, a first hole, and second hole and an insertion opening. The first hole, the second hole and the insertion opening are respectively connected to the accommodating space and external space outside the casing. The first hole and the second hole are respectively formed on a first surface of the casing, and the insertion opening is formed on a second surface of the casing, whereon the first surface is adjacent to the second surface. The terminal is disposed in the accommodating space. The terminal is capable of electrically connecting the wire end. The first elastic locking part is disposed in the accommodating space and close to a lateral side of the casing. The first elastic locking part includes a first operating part, a first locking protrusion and a first elastic arm. The upper portion of the first operating part is protruded from the first hole while the lower portion of the first operating part is contained in the accommodating space. The upper portion and the lower portion of the first operating part correspond in the same direction. The first locking protrusion is formed in the lower portion of the first operating part. The first elastic arm extends from the lower portion of the first operating part to the inner side of a third surface of the casing, wherein the third surface corresponds to the first surface. The second elastic locking part is disposed in the accommodating space and close to the opposite lateral side of the casing. The second elastic locking part includes a second operating part, a second locking protrusion and a second elastic arm. The upper portion of the second operating part is protruded from the second hole while the lower portion of the second operating part is contained in the accommodating space. The upper portion and the lower portion of the second operating part correspond in the same direction. The second locking protrusion is formed in the lower portion of the second operating part. The second elastic arm extends from the lower portion of the second operating part to the inner side of the third surface of the casing, wherein the third surface corresponds to the first surface. When the flat conducting wire is directed into the insertion opening, the front end comes in contact with the first locking protrusion and the second locking protrusion, causing the first elastic arm and the second elastic arm to deform, thereby causing the first operating part and the third operating part to move towards the third surface until the indented notches correspond to the first locking protrusion and the second locking protrusion, which subsequently causes the first elastic arm and the second elastic arm to return to their former position by means of elastic force, latch-locking the front end of the flat conducting wire in the accommodating space. And through exerting an external force on the upper portion of the first operating part and the upper portion of the second operating part, the first elastic arm and the second elastic arm are respectively deformed for the front end of the flat conducting wire to unlatch and separate from the accommodating space.

Compared to the prior art, the present invention provides a connector for flat conducting wires, enabling the conducting wires to be automatically latch-locked in the accommodating space of the connector and electrically connected to the terminal inside the accommodating space; in addition, by means of exerting an external force on the upper portion of the operating part which is outside the accommodating space of the connector, the lower portion of the operating part can be directly driven (i.e. forming the locking protrusion), achieving zero or close to zero loss of the external force exerting on the locking protrusion.

Compared to conventional connectors wherein the insertion depth of a flat conducting wire must exceed the operating part (i.e. a specific pre-determined depth) to perform automatic latch-locking, the locking protrusions of the present invention are close to the insertion opening of the casing, particularly to the lower portion of the operating parts, thereby effectively adjusting the depth into the casing rather than being limited to a particular depth to achieve the efficacy of the automatic latch-locking.

Moreover, because the locking protrusions of the present invention directly correspond to the upper portion of the operating parts, a user can easily determine the inserted depth of the flat conducting wire required to achieve the efficacy of automatic latch-locking.

DETAILED DESCRIPTION OF THE PREFERRED EMBODIMENTS

Figure 1:
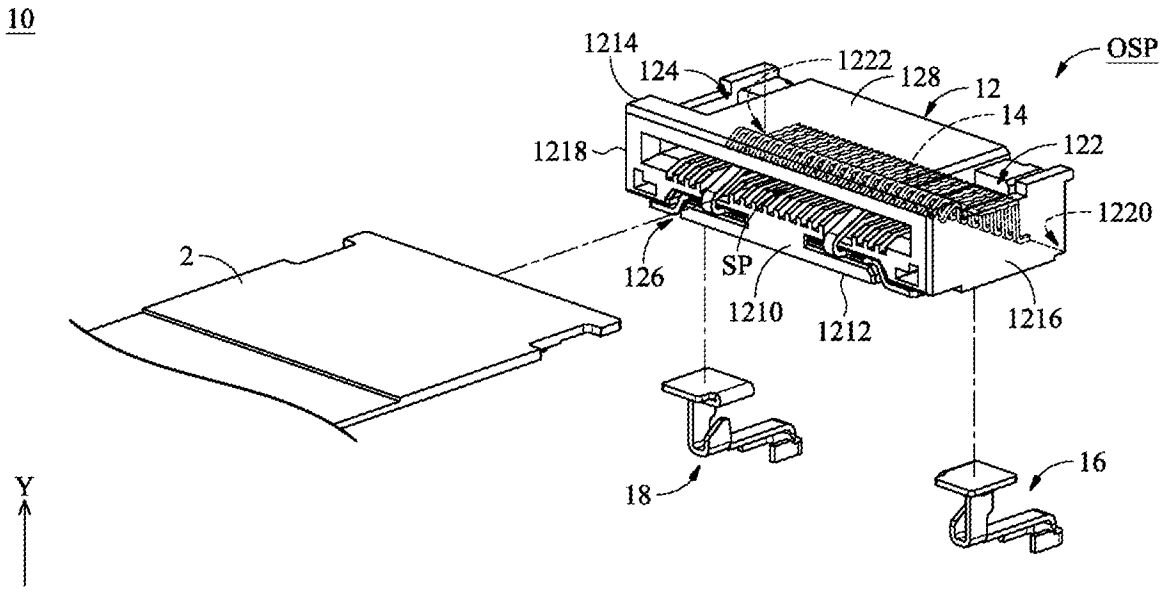
FIG. 1 is the schematic view of an embodiment of the connector of the present invention.

In order to better understand this invention, its content and the efficacy it can achieve, the invention is explained with the attached figures, and the following is a detailed description of the embodiments. The schematics used in the drawings are only for the purpose of illustration and complementation. It is not intended to be a true proportion and precise configuration of the implementation of the present invention. Therefore, it would not be proper to interpret the proportion and configuration of the illustrations as such, and to limit the scope of rights and actual usage of this invention.

The advantages and characteristic features of the present invention as well as the achieved technology use the reference implementation and all the attached figures to conduct a more in depth description and be more easily understandable; moreover the present invention can be realized in different shapes, therefore it should not be understood as limited to the implementation described in the present state; on the contrary, for those who possess general knowledge of the technological field, the implementation hereby shown will make it possible for the present disclosure to more thoroughly express the domain of the present invention; moreover, the present invention is exclusively defined by the attached patent application area.

The description of unit, element and component in the present invention uses "one", "a", or "an". The way mentioned above is for convenience, and for general meaning of the category of the present invention. Therefore, the description should be understood as "include one", "at least one", and include the singular and plural forms at the same time unless obvious meaning.

The description of comprise, have, include, contain, or another similar semantics has the non-exclusive meaning. For example, an element, structure, product, or device contain multi requirements are not limited in the list of the content, but include another inherent requirement of element, structure, product or device not explicitly listed in the content. In addition, the term "or" is inclusive meaning, and not exclusive meaning.

Figure 2:
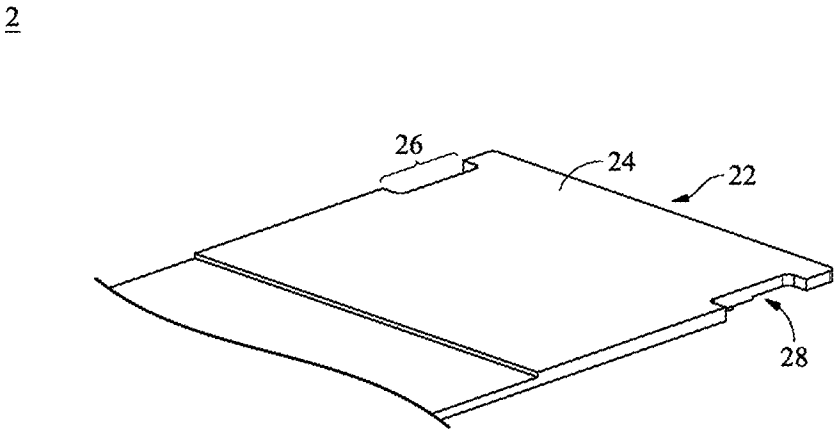
FIG. 2 is the schematic view illustrating the conducting wire of FIG. 1 of the present invention.

Please refer to FIG. 1, where FIG. 1 is a schematic view of an embodiment of the connector of the present invention. In FIG. 1, the connector 10 is suitable for the conducting wire 2, wherein with reference to FIG. 2, the conducting wire 2 includes a wire end 22 and the indented notches 28 respectively formed on the two lateral sides 26 of the front end 24.

The connector 10 includes a casing 12, a terminal 14 and a first elastic locking portion 16 and a second elastic locking portion 18.

The casing 12 further forms a accommodating space (SP), a first hole 122, a second hole 124 and an insertion opening 126. The casing 12 can be of electrically insulating material. In this embodiment, the casing 12 is rectangular in shape, whereas in other embodiments, the shape of the casing 12 may be subject to change subject to different circumstances. Herein, for the purpose of illustration, each surface of the casing 12 is so defined that the casing 12 provides a first surface 128, a second surface 1210, a third surface 1212, a forth surface 1214, a first lateral side 1216, a second lateral side 1218, a first inner side 1220 and a second inner side 1222. Furthermore, the first hole 122, the second hole 124 and the insertion opening 126 respectively connect to the accommodating space (SP) and the external space (OSP) outside the casing 12. In this embodiment, the first hole 122 and the second hole 124 are respectively formed on the two opposite sides of the first surface 128 and are close to the insertion opening 126, wherein the insertion opening 126 is formed on the second surface 1210. The aforesaid first surface 128 is adjacent to the said second surface 1210.

The terminal 14 is disposed in the accommodating space (SP) for electrically connecting the wire end 22 to enable data transmission through signals on the flat conducting wire 2, wherein the wire end 22 has characteristics of data transmission and electric ground.

The first elastic locking part 16 and the second elastic portion 18 are disposed symmetrically; therefore, only the first elastic locking part 16 will be used for illustration purpose hereinafter, as the second elastic locking part 18, due to its symmetrical relation to its counterpart, has the same structural arrangement as the first elastic locking part 16. Beside a special mention of the relationship between the second locking part 18 and the first locking part 16, relevant labels and description may be deemed as identical.

The first elastic locking part 16 is disposed in the accommodating space (SP) near the first lateral side 1216 of the casing 12. The first elastic locking part 16 further includes a first operating part 162, a first locking protrusion 164 and a first elastic arm 166; similarly, the second elastic locking part 18 is disposed in the accommodating space (SP) near the second lateral side 1218 of the casing 12. The second elastic locking part 18 further includes a second operating part 182, a second locking protrusion 184 and a second elastic arm 186.

Of the first elastic locking part 16, the upper portion 1622 of the first operating part 162 is protruded from the first hole 122 while the lower portion 1624 of the first operating part 162 is contained in the accommodating space (SP). The upper portion 1622 and the lower portion 1624 of the first operating part 162 correspond to each other in the Y-axis. In this embodiment, the upper portion 1622 of first operating part 162 is T-shaped while the lower portion 1624 of the first operating part 162 is C-shaped. In other words, the structure of the first operating part 162 has a T-C combination in shape.

Figure 3:
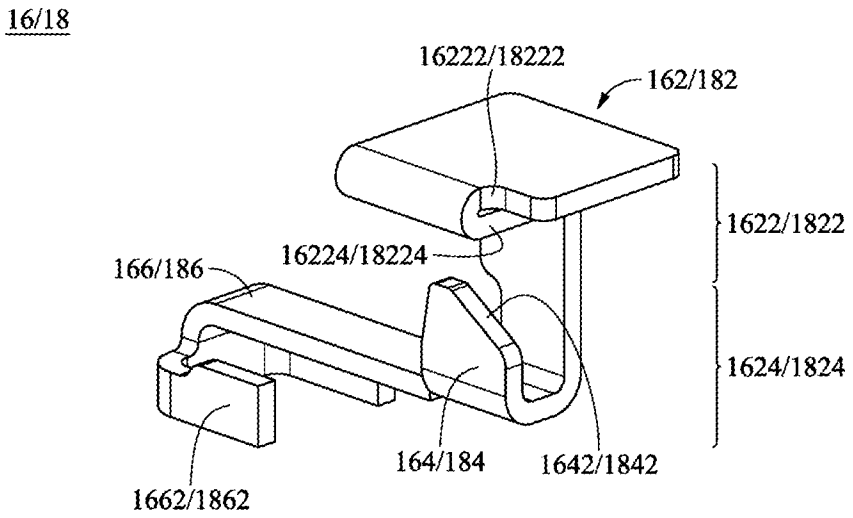
FIG. 3 is a first schematic view illustrating the operating parts of FIG. 1 of the present invention.

Please also refer to FIG. 3, which is a schematic view illustrating the operating parts of FIG. 1 of the present invention. In FIG. 3, the upper portion 1622 of the first operating part 162 is composed of a operating part 16222 and an extension part 16224. The curved extension part 16224 of the first operating part 162 serves to connect to the lower portion 1624 of the first operating part 162.

Figure 4:
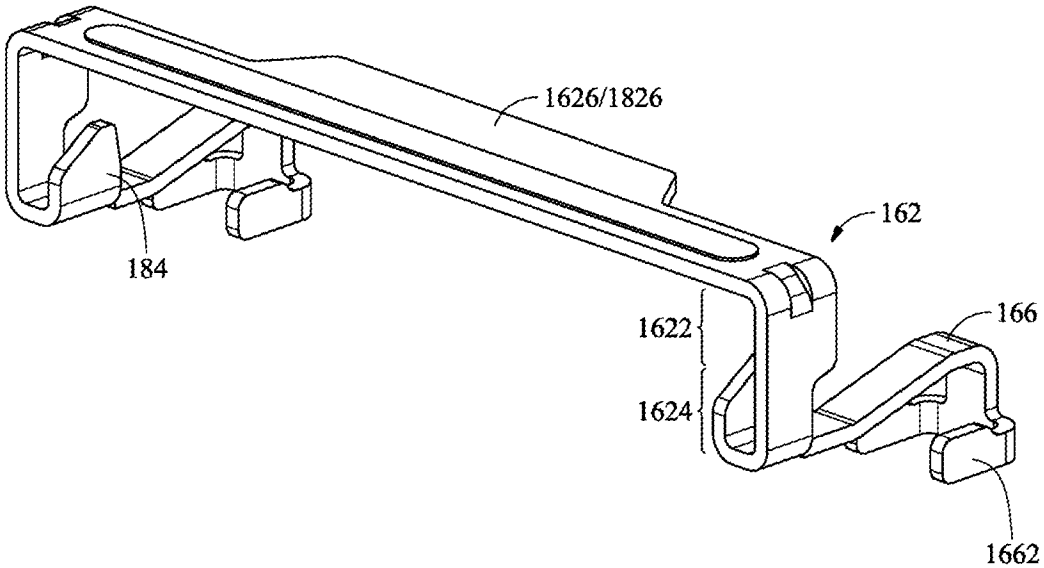
FIG. 4 is a second schematic view illustrating the operating parts of FIG. 1 of the present invention.

Please yet refer to the FIG. 4, which is a schematic view illustrating the operating part of FIG. 1 of the present invention. In FIG. 4, the upper portion 1622 of the first operating part 162 and the upper portion 1822 of the second operating part 182 are connected through a common operating part 1626, while the upper portion 1622 of the first operating part 162 from the common operating part 1626 connects to the lower portion 1624 of the first operating part 162 through the extension part 16224. In this embodiment, the total area of the common operating part 1626 adjacent to the upper portion 1622 of the first operating part 162 and the upper portion 1822 of the second operating part 182 is smaller than that of the central region of the common operating part 1626. In other embodiments, the total area of the common operating part 1626 adjacent the upper portion 1622 of the first operating part 162 and the upper portion 1822 of the second operating part 182 is equal to or larger than that of the central region of the common operating part 1626.

Returning to FIG. 3, the first locking protrusion 164 is formed at the lower portion 1624 of the first operating part 162, wherein the structural shape of the first locking protrusion 164 is trapezoid, and the structural shape of the first locking protrusion 164 facing the insertion opening 126 has a structural shape of a guiding slope 1642 which facilitates the flat conducting wire 2 to slide into the accommodating space (SP).

The first elastic arm 166 extends from the lower portion 1624 of the first operating part 162 to the first inner side 1220, wherein the first inner side 1220 is located on the inner side of the third surface 1212. Moreover, in this embodiment, the first elastic arm 166 further includes an elastic base 1662, forming the end which is not connected to the lower portion 1624 of the first operating part 162, the elastic base 1662 may be fixed on the first inner side 1220. Also referring to FIG. 3, the first elastic arm 166 extends horizontally from the lower portion 1624 of the first operating part 162; further referring the FIG. 4, the first elastic arm 166 may also extend from the lower portion 1624 of the first operating part 162 towards the first surface 128. Besides the aforesaid configurations shown in FIG. 3 and FIG. 4, the first elastic arm 166 may also have a combined configuration of the aforesaid, for example, where the first elastic 166 first extends horizontally and then continues towards the first surface 128.

The illustration of the first elastic locking part 16 can be applied to the unmentioned parts of the second elastic locking part 18 so the illustration thereof is hereby omitted.

Hence, as the flat conducting wire 2 is directed into the insertion opening 126, the front end 24 comes in contact with the first locking protrusion 164 and the second locking protrusion 184, respectively causing the first elastic arm 166 and the second elastic arm 186 to deform, thereby rendering the first operating part 162 and the second operating part 182 to move towards the third surface 1212 until the indented notch 28 corresponds to the first locking protrusion 164 and the second locking protrusion 184, which subsequently causes the first elastic arm 166 and the second elastic arm 186 to return to their former position by means of elastic force, latch-locking the front end 24 of the flat conducting wire 2 in the accommodating space (SP). And through exerting an external force (F) on the upper portion 1622 of the first operating part 162 and the upper portion 1822 of the second operating part 182, the first elastic arm 166 and the second elastic arm 186 are deformed for the front end 24 of the flat conducting wire 2 to unlatch and separate from the accommodating space. The aforesaid separation can also be expedited with a user's pulling motion.

The present invention is disclosed by the preferred embodiment in the aforementioned description; however, it is contemplated for one skilled at the art that the embodiments are applied only for an illustration of the present invention rather than are interpreted as a limitation for the scope of the present invention. It should be noted that the various substantial alternation or replacement equivalent to these embodiments shall be considered as being covered within the scope of the present invention. Therefore, the protection scope of the present invention shall be defined by the claims.

What is claimed is:

1. A connector for a flat conducting wire, the flat conducting wire has a wire end and indented notches formed respectively on the two lateral sides of the front end of the wire, the connector comprises:

a casing forming an accommodating space, a first hole, a second hole and an insertion opening, wherein the first hole, the second hole, the insertion opening are respectively connected to the accommodating space and external space outside the casing, the first hole and the second hole being respectively formed on a first surface of the casing, and the insertion opening being formed on a second surface of the casing, wherein the first surface is adjacent to the second surface;

a terminal disposed in the accommodating space, the terminal being capable of electrically connecting to the wire end;

a first elastic locking part disposed in the accommodating space and close to a lateral side of the casing, the first elastic locking part including a first operating part, a first locking protrusion and a first elastic arm, wherein the upper portion of the first operating part is protruded from the first hole while the lower portion of the first operating part is disposed in the accommodating space, the upper portion and the lower portion of the first operating part corresponding to each other in the same direction, the first locking protrusion is formed at the lower portion of the first operating part, the first operating part and the first locking protrusion being respectively connected to the first elastic arm, and the first elastic arm extends from the lower portion of the first operating part to the inner side of a third surface of the casing, wherein the upper portion of first operating part is T-shaped and the lower portion of the first operating part is C-shaped;

a second elastic locking part disposed in the accommodating space and close to the other lateral side of the casing, the second elastic locking part including a second operating part, a second locking protrusion and a second elastic arm, wherein the upper portion of the second operating part is protruded from the second hole while the lower portion of the second operating part is disposed in the accommodating space, the upper portion and the lower portion of the second operating part corresponding to each other in the same direction, the second locking protrusion is formed at the lower portion of the second operating part, the second operating part and the second locking protrusion being respectively connected to the second elastic arm, and the second elastic arm extends from the lower portion of the second operating part to the inner side of the third surface of the casing, wherein the upper portion of the second operating part is T-shaped and the lower portion of the second operating part is C-shaped; and the upper portion of the first operating part and the upper portion of the second operating part are respectively composed of an operating part and an extension part, the operating parts being connected respectively to the lower portion of the first operating part and the lower portion of the second operating part through the curved extension parts;

wherein the flat conducting wire is directed into the insertion opening, the front end comes in contact with the first locking protrusion and the second locking protrusion, respectively causing the first elastic arm and the second elastic arm to deform, thereby causing the first operating part and the second operating part to move towards the third surface until the indented notches correspond to the first locking protrusion and the second locking protrusion, which subsequently causes the first elastic arm and the second elastic arm to return to their former position by means of elastic force, latch-locking the front end of the flat conducting wire in the accommodating space, and through exerting an external force on the upper portion of the first operating part and the upper portion of the second operating part, the first elastic arm and the second elastic arm are respectively deformed for the front end of the flat conducting wire to unlatch and separate from the accommodating space.

2. The connector according to claim 1, wherein the upper portion of the first operating part and the upper portion of the second operating part are connected through a common operating part, the upper portion of the first operating part and the upper portion of the second operating part connecting respectively from the common operating part to the lower portion of the first operating part and the lower portion of the second operating part through the extension part.

3. The connector according to claim 2, wherein the total area of the common operating part adjacent to the upper portion of the first operating part and the upper portion of the second operating part is no greater than that of the central region of the common operating part.

4. The connector according to claim 1, wherein the first elastic arm and the second elastic arm further include an elastic base, forming one end which is opposite to the other end where the first elastic arm and the second elastic arm are connected to the lower portion of the first operating part and the lower portion of the second operating part, the elastic base being fixed on the inner side of the third surface.

5. The connector according to claim 1, wherein the first elastic arm and the second elastic arm extend horizontally from the lower portion of the first operating part and the lower portion of the second operating part respectively.

6. The connector according to claim 1, wherein the first elastic arm and the second elastic arm extend respectively from the lower portion of the first operating part and the lower portion of the second operating part towards the first surface.

7. The connector according to claim 1, wherein the first elastic arm and the second elastic arm extend horizontally first respectively from the lower portion of the first operating part and the lower portion of the second operating part and then continue towards the first surface.

8. The connector according to claim 1, wherein the structural shape of the first locking protrusion and the second locking protrusion is trapezoid, and the structural shape of the first locking protrusion and the second locking protrusion facing the insertion opening has a structural shape of a guiding slope.

* * * * *